US006267053B1

(12) United States Patent
Miske et al.

(10) Patent No.: US 6,267,053 B1
(45) Date of Patent: Jul. 31, 2001

(54) PERF/SCORE SHELL FOR PRESSES

(75) Inventors: Michael T. Miske, Chicago; Billy D. Hatcher, Peoria, both of IL (US)

(73) Assignee: Environmental Specialties Inc., Chicago, IL (US)

( * ) Notice: Subject to any disclaimer, the term of this patent is extended or adjusted under 35 U.S.C. 154(b) by 0 days.

(21) Appl. No.: 09/440,861

(22) Filed: Nov. 16, 1999

Related U.S. Application Data

(60) Provisional application No. 60/108,562, filed on Nov. 16, 1998.

(51) Int. Cl.[7] ..... B41F 13/56
(52) U.S. Cl. ..... 101/226
(58) Field of Search ..... 101/226, 227, 101/378, 382.1, 401.1, 415.1, 486

(56) References Cited

U.S. PATENT DOCUMENTS

| | | | | |
|---|---|---|---|---|
| 737,052 | | 8/1903 | Allen . | |
| 1,414,104 | | 4/1922 | Strawn . | |
| 2,199,973 | | 5/1940 | Sheeler et al. . | |
| 3,012,498 | | 12/1961 | Gurin . | |
| 3,765,329 | | 10/1973 | Kirkpatrick et al. . | |
| 3,926,118 | * | 12/1975 | Preuss | 101/246 |
| 3,995,555 | * | 12/1976 | Stewart | 101/227 |
| 4,006,686 | | 2/1977 | Ackerman . | |
| 4,337,700 | | 7/1982 | Etchell et al. . | |
| 4,402,265 | * | 9/1983 | Pickard | 101/415.1 |
| 4,598,641 | * | 7/1986 | Fischer | 101/246 |
| 4,951,568 | * | 8/1990 | Tsukamoto et al. | 101/415.1 |
| 5,052,120 | | 10/1991 | Lubberts . | |
| 5,088,408 | * | 2/1992 | Philpot | 101/415.1 |
| 5,623,874 | | 4/1997 | Ruprecht . | |
| 5,918,542 | | 7/1999 | Ruprecht . | |

* cited by examiner

*Primary Examiner*—Ren Yan
(74) *Attorney, Agent, or Firm*—Piper Marbury Rudnick & Wolfe

(57) ABSTRACT

A shell featuring a main body formed of a hard and flexible sheet-like substance, such as stainless steel, is substituted for the rubber blanket of a blanket cylinder in a lithograph offset press. Perforating material that includes spaced teeth with flat edges are mounted on the impression cylinder and engage the main body of the shell to form perforations without shoulder defects. Slitting or scoring may also be accomplished by the arrangement. Stabilizing strips are positioned upon the main body of the shell in sheet-fed press applications. Flexible rubber sheets are mounted to the ends of the main body. Blanket bars are also mounted to the flexible rubber sheets. The blanket bars engage the lock-up of the blanket cylinder to secure the shell in position.

11 Claims, 4 Drawing Sheets

FIG. 9
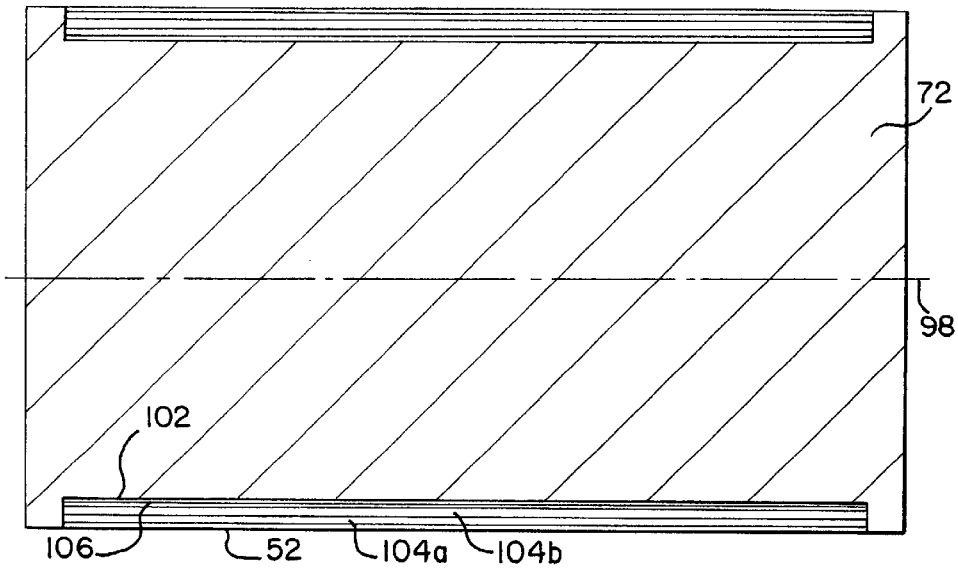
FIG. 10
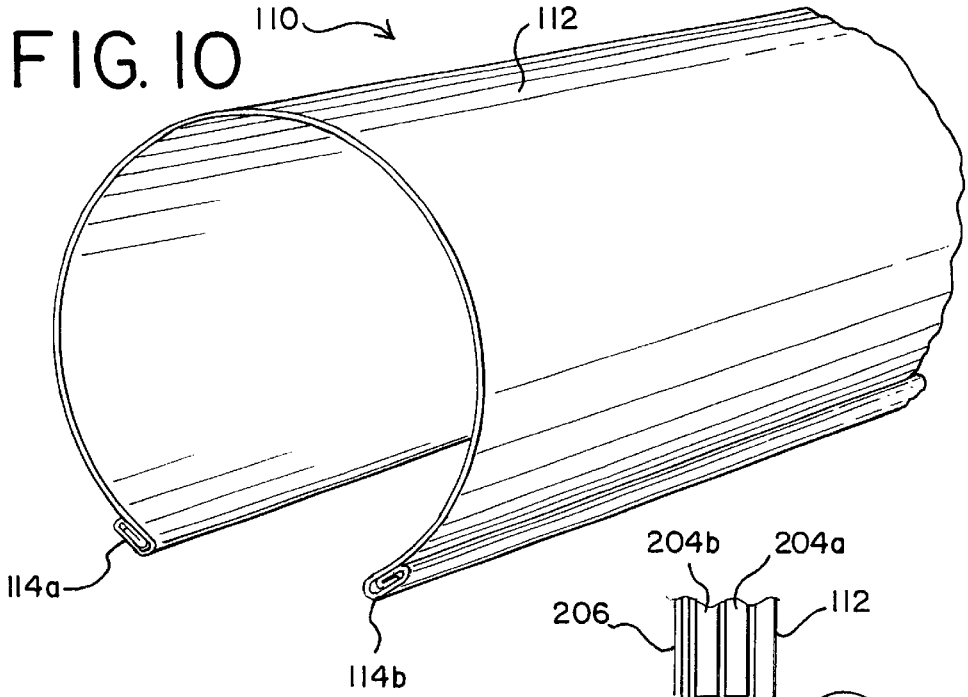
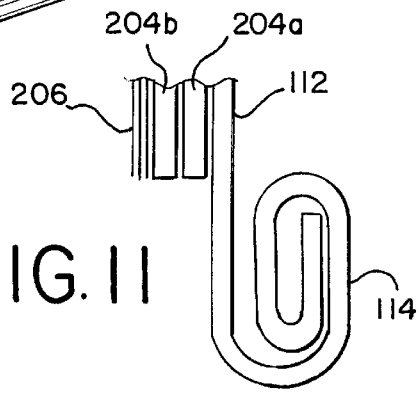
FIG. 11

PERF/SCORE SHELL FOR PRESSES

This application claims the benefit of the filing date of U.S. Provisional Application No. 60/108,562 filed Nov. 16, 1998.

BACKGROUND OF THE INVENTION

The invention relates generally to lithograph offset printing presses and, more particularly, to an improved shell for use in place of a standard rubber blanket when applying a perf, score or slit to a substrate in an offset printing press.

As shown in FIG. 1, a typical offset press printing group includes a plate cylinder 20, an impression cylinder 22 and a blanket cylinder 24. The blanket cylinder 24 is covered with a rubber blanket 26 and contacts the impression cylinder 22. A printing plate 28 featuring text or images is attached to the plate cylinder 20. Ink is supplied to the plate cylinder 20 so that the text or images of the printing plate are transferred onto the blanket cylinder 24 and ultimately onto a substrate, such as paper 32.

As illustrated in FIG. 1, perforating material 34 may be placed about the impression cylinder 22 so that the printing group applies perforations to the substrate 32 instead of printed text or images. Slitting or scoring material may be substituted for, or used in addition to, perforating material 34. As illustrated in FIG. 2, typical perforating material includes spaced teeth 40 with pointed or curved tips 42 that dig into the rubber blanket 26 of the blanket cylinder 24 (FIG. 1).

The perforating arrangement of FIGS. 1 and 2 have two significant disadvantages. First, the process damages the rubber blanket of the blanket cylinder over time so that reuse of the blanket is prevented. Second, a quality defect called a "shoulder" is produced on the substrate due to the flexibility of the rubber blanket. A shoulder, illustrated at 46 in FIG. 3, is a raised area on the substrate 32 that runs parallel to the perforation 48 (or score). In some instances, the shoulders may become severe enough that sheets of the substrate cannot be stacked for ease of subsequent processing.

In an attempt to overcome the above problems, shells or foils that are substituted for the rubber blanket of the blanket cylinder during perforating, slitting or scoring operations have been introduced. An example of such an arrangement is presented in U.S. Pat. No. 5,623,874 to Ruprecht. While the prior art arrangements have been effective, their performances have been less than optimal. In addition, installation of the prior art devices could be facilitated.

Accordingly, it as object of the present invention to provide a perf/score shell for presses that enables perforations, slits and scores to be formed in a substrate without creating shoulder defects.

It is a further object of the present invention to provide a perf/score shell for presses that may be used repeatedly.

It is a further object of the present invention to provide a perf/score shell for presses that enables perforations, slits and scores to be formed in a substrate going around the cylinders of the presses and across the cylinders of the presses with equal quality.

It is still a further object of the invention to provide a perf/score shell for presses that is easy to install using existing cylinder lock-ups.

It is still a further object of the invention to provide a perf/score shell that may be used on sheet-fed offset presses and the perf units of web offset presses.

SUMMARY OF THE INVENTION

The present invention is directed to a system for perforating, scoring or slitting a substrate passing between the impression and blanket cylinders of a sheet-fed offset press or the plate and blanket cylinders of a perf unit of a web offset press. The shell includes a main body constructed of a hard and flexible sheet-like substance such as stainless steel.

In the case of a sheet-fed offset press, flexible sheets constructed of rubber are attached to the end portions of the main body by rivets. Blanket bars are attached to the flexible sheets by bolts or are compressed on with adhesive. Stability strips constructed of self-adhesive foam are attached to the surface of the main body. The shell is substituted for the rubber blanket typically used on the blanket cylinder. The blanket bars engage the lock-up of the blanket cylinder. Perforation material featuring spaced teeth with flat edges are mounted onto the impression cylinder. The flat edges of the spaced teeth lightly contact or "kiss" the main body of the shell on the blanket cylinder so that perforations are formed without shoulder defects. Slitting or scoring material may be used in place of or in addition to the perforating material.

The shell may also be utilized on the perf unit of a web offset press. The end portions of the main body are folded so that borders are formed for engaging the blanket cylinder.

The following detailed description of embodiments of the invention, taken in conjunction with the appended claims and accompanying drawings, provide a more complete understanding of the nature and scope of the invention.

BRIEF DESCRIPTION OF THE DRAWINGS

FIG. 9 is a sectional view of the blanket cylinder of FIG. 8 taken along line 9–9;

FIG. 10 is a perspective view of a perf/score shell for use in the perf unit of a web offset press constructed in accordance with the present invention;

FIG. 11 is an enlarged partial side elevational view of an end of the perf/score shell of FIG. 10.

DESCRIPTION OF THE PREFERRED EMBODIMENTS

Figure 4:
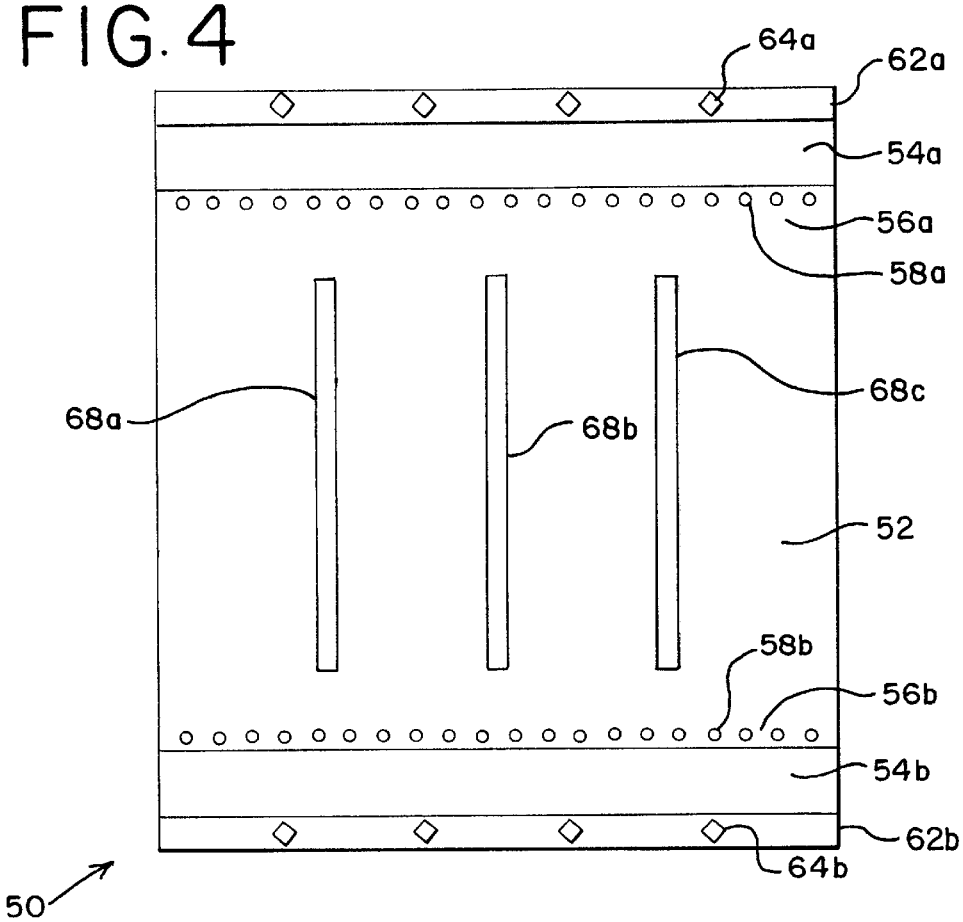
FIG. 4 is a top plan view of a perf/score shell for use in a sheet-fed offset press constructed in accordance with the present invention.

A perf/score shell constructed in accordance with the present invention is indicated in general at 50 in FIG. 4. As described in greater detail below, the perf/score shell is substituted for the rubber blanket of a blanket cylinder in a sheet-fed offset printing press when it is desirable to perforate, score or slit a substrate such as paper, paperboard, cardboard, etc. The perf/score shell includes a main body 52 constructed of sheet metal material such as stainless steel alloy 304. It is to be noted that sheet metal is presented as an example only and that other relatively hard, flexible materials, such as other metals, suitable plastics or synthetic materials, may be utilized in constructing the main body 52.

Figure 5:
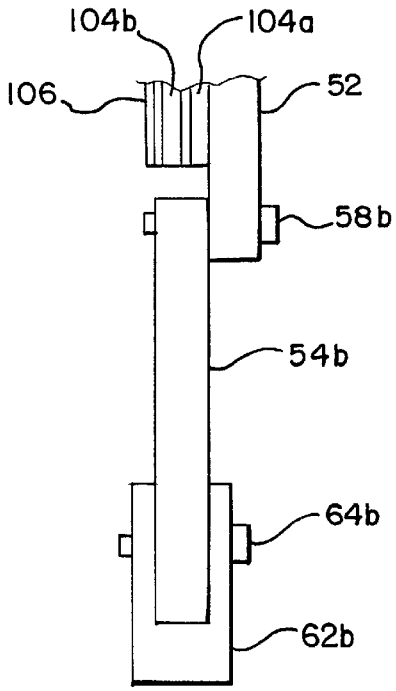
FIG. 5 is an enlarged partial side elevational view of an end of the perf/score shell of FIG. 4.

As illustrated in FIGS. 4 and 5, two flexible sheets 54*a* and 54*b*, constructed of rubber, for example, are secured to opposite end portions 56*a* and 56*b* of the main body 52 by rivets 58*a* and 58*b* and adhesive. A pair of blanket bars 62*a* and 62*b*, constructed of aluminum, for example, are secured to the flexible sheets 54*a* and 54*b* by bolts 64*a* and 64*b*. Note that the blanket bars may instead be secured to the flexible sheets via compression and adhesive. As will be described in greater detail below, the blanket bars are used to secure the perf/score shell to the blanket cylinder. The type of blanket bar utilized will vary depending on the blanket cylinder lock-up furnished by the manufacturer of the press. Furthermore, while flexible sheets and blanket bars are shown attached to both ends of the main body 52, some cylinder lock-ups require that only one end of the main body have a flexible sheet and blanket bar attached thereto. It is to be understood that the flexible sheets may be secured to the main body and the blanket bars by alternative attachment arrangements.

Friction-enhancing stabilizing strips 68*a* through 68*c* are secured to the surface of main body 52. The stabilizing strips are preferably constructed of self-adhesive foam an gently hold the substrate in place during the perforating, slitting or scoring operation. The placement of the stabilizing strips on the blanket cylinder vary depending upon the placement of the perforating, slitting or scoring material on the impression cylinder, as dictated by the particular job design. As an example only, a stabilizing strip thickness of approximately 3/16" and a width of approximately 3/8" is appropriate for some jobs.

Figure 6:
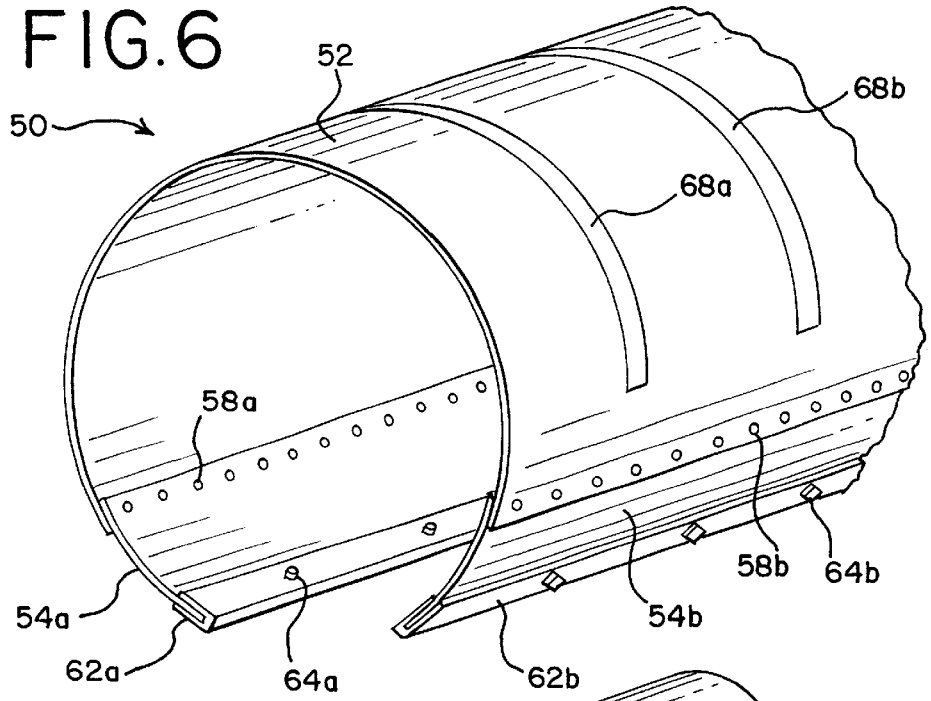
FIG. 6 is a partial perspective view of the perf/score shell of FIG. 4.
Figure 7:
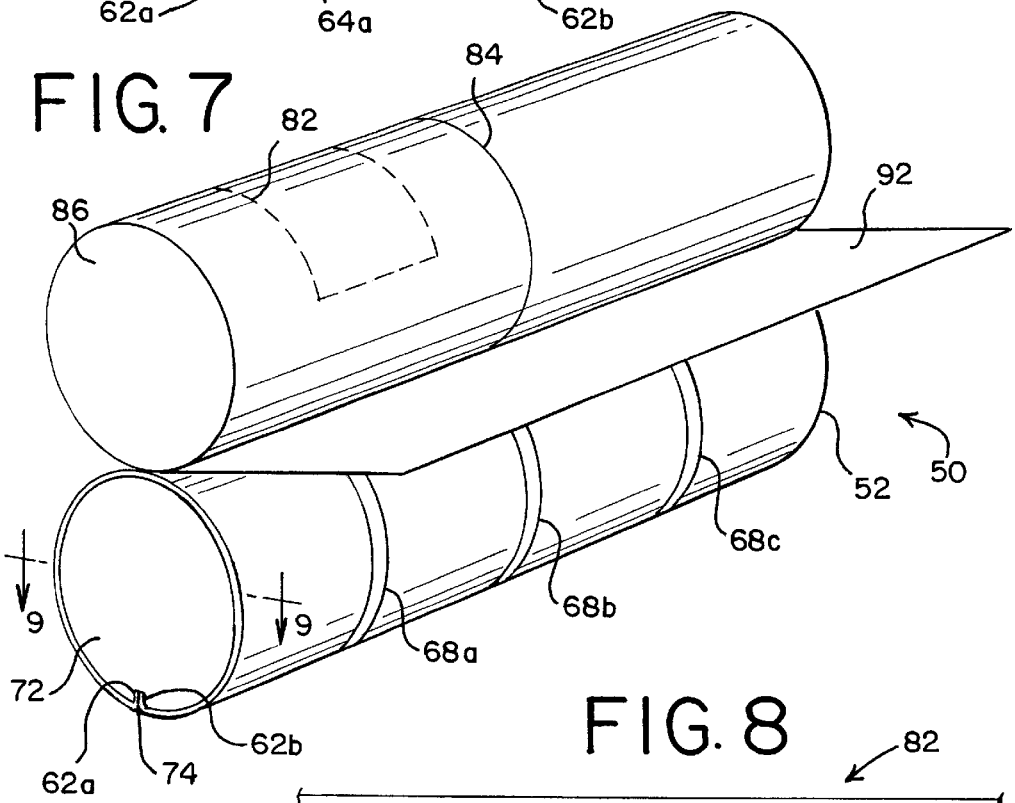
FIG. 7 is a perspective view of the perf/score shell of FIGS. 4–6 and perforating and scoring material installed on the blanket and impression cylinders, respectively, of a sheet-fed offset press.

As illustrated in FIG. 6, the blanket bars 62*a* and 62*b* are brought towards one another as the perf/score shell is being installed. As a result, the main body 52 assumes an arc-like shape. As illustrated in FIG. 7, the perf/score shell 50 is placed over a blanket cylinder 72 of a sheet-fed offset press with the blanket bars 62*a* and 62*b* in engagement with the blanket cylinder lock-up 74.

Perforating material 82 and scoring material 84 are mounted upon the impression cylinder 86 by means known in the art. The perforating and scoring material are mounted with their teeth pointing radially out from the impression cylinder, that is, in the direction of the blanket cylinder 72. As a result, a substrate, such as paperboard 92, is perforated and scored as it passes between the impression and blanket cylinders. As stated previously, the stabilizing strips 68a through 68c gently secure the substrate in place as the operations are performed.

Figure 1:
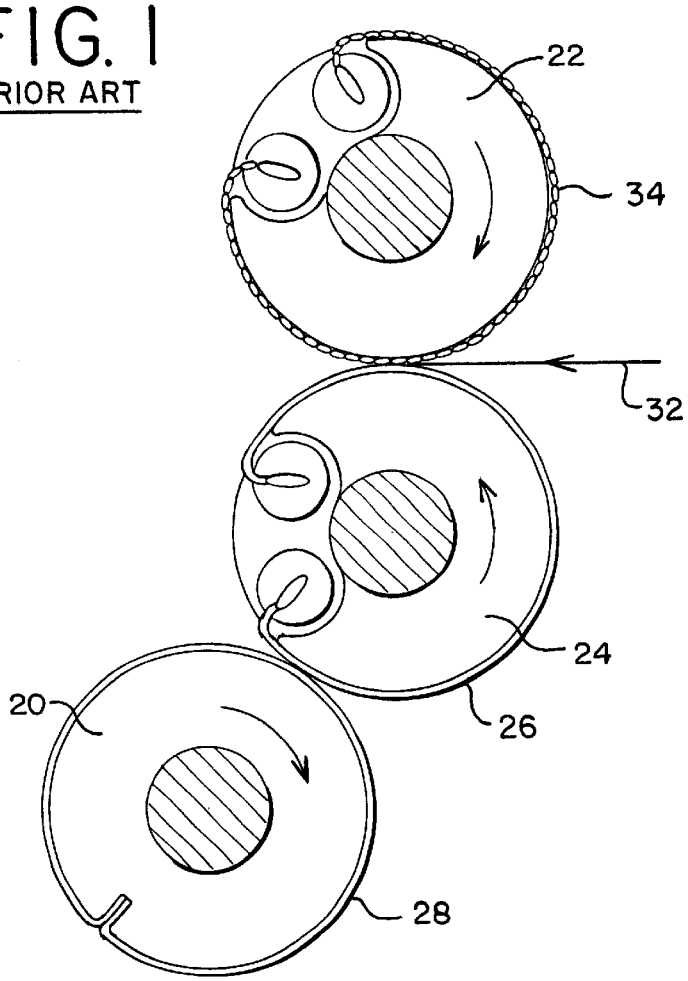
FIG. 1 PRIOR ART
FIG. 1 is a side elevational view of a printing group of an offset printing press utilizing a prior art perforating arrangement.
Figure 2:
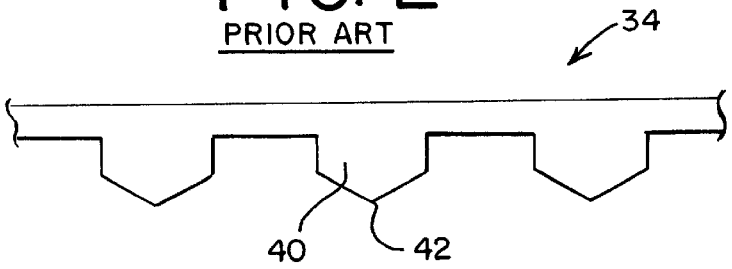
FIG. 2 PRIOR ART
FIG. 2 is an enlarged side elevational view of the perforating material of FIG. 1.
Figure 3:
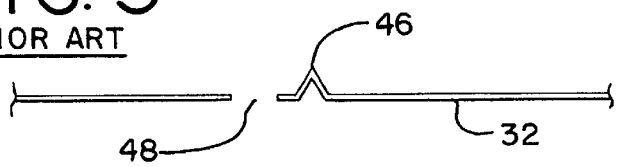
FIG. 3 PRIOR ART
FIG. 3 is an enlarged side elevational view of the substrate of FIG. 1 after perforating.
Figure 8:
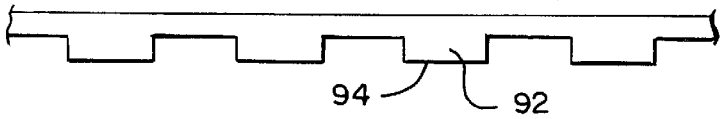
FIG. 8 is a side elevational view of perforating material suitable for use with the perf/score shell of the present invention.

An enlarged view of the perforating material is illustrated in FIG. 8. The perforating material 82 includes a number of spaced teeth 92 each of which features a flat edge 94. The orientation of the impression and blanket cylinders of FIG. 7 are such that the teeth 92 of the perforating material lightly contact or "kiss" the main body 52 of the perf/score shell 50. The edge of the scoring material 84 also lightly contacts the main body 52 of the perf/score shell 50. As a result, perforations and scores are formed in the substrate 92 without the shoulder defects described with reference to FIG. 3.

In order for the perforating, scoring and slitting operations to be effectively performed, the thickness of the covering of the blanket cylinder 72 must be appropriate. With regard to FIG. 9, where the cross section of the blanket cylinder 72 is shown and the cylinder axis is indicated at 98, the thickness of the main body 52 is much less than that of the removed rubber blanket. For example, the thickness of the main body 52, when constructed of stainless steel alloy 304, is approximately 0.020". Accordingly, it is necessary to place packing layers between the blanket cylinder surface 102 and the main body 52. For example, the material may include two layers of permanent packing polyester film 104*a* and 104*b* that are each 0.024" thick. Metal packing, as well as a variety of other materials, may be used in place of the polyester film as permanent packing. Further thickness may be obtained by placing miscellaneous paper packing 106 between the permanent packing 104*a* and 104*b* and the blanket cylinder surface 102. See also FIG. 5.

An embodiment of the perf/score shell of the present invention suitable for use in the perf unit of a web offset press is indicated in general at 110 in FIG. 10. The perf/score shell 110 also includes a main body 112 made of sheet metal or an alternative hard, flexible material. Flexible sheets and blanket bars, however, are not attached to the ends of the main body 112. Instead, as illustrated in FIGS. 10 and 11, the ends of the main body 112 are folded to form borders 114*a* and 114*b*. These borders are used to secure the perf/score shell 110 in the blanket cylinder of the perf unit of the web offset press.

The perforating material of FIG. 8 is mounted onto the plate cylinder of the perf unit so that perforations may be formed in the substrate of the web. Of course, slit or scoring material may be substituted for, or used in addition to, the perforating material in the perf unit. As a result, the perf unit of the web offset press produces perforations, slits or scores without the shoulder defects described with regard to FIG. 3.

As illustrated in FIG. 10, permanent packing 204*a* and 204*b* and paper packing 206 may also be utilized between the cylinder of the perf unit and the main body 112 to obtain the appropriate thickness for the perf/score shell 110.

While the preferred embodiments of the invention have been shown and described, it will be apparent to those skilled in the art that changes and modifications may be made therein without departing from the spirit of the invention, the scope of which is defined by the appended claims.

What is claimed is:

1. A system for perforating, scoring or slitting a substrate passing between a first cylinder and a second cylinder in a press comprising:

a. a shell wrapped about a first cylinder of the press, said shell including a main body constructed of a hard and flexible sheet-like substance and means for securing the main body to the first cylinder; and b. a material including a flat edge attached to the second cylinder, said flat edge lightly contacting the main body of said shell as the substrate passes between the first and second cylinders so as not to deform the main body and so that a perforation, score or slit is formed in the substrate.

2. The system of claim 1 wherein the material is a perforating material featuring a tooth having the flat edge.

3. The system of claim 2 wherein the perforating material includes a plurality of spaced teeth.

4. The system of claim 1 further comprising a layer of permanent packing placed between the main body and the first cylinder.

5. The system of claim 1 comprising a layer of paper packing placed between the main body and the first cylinder.

6. The system of claim 1 wherein the means for securing the main body to the first cylinder includes a flexible sheet attached to an end portion of the main body and a blanket bar attached to the flexible sheet, said blanket bar adapted to engage a lock-up of the first cylinder.

7. The system of claim 1 wherein the means for securing the main body to the first cylinder includes a plurality of overlapping folds in the main body so that borders are formed, said borders engaging a lock-up of the first cylinder.

8. The system of claim 1 further comprising a friction-enhancing stability strip attached to a surface of the main body, said stability strip facing radially away from the first cylinder when said shell is attached thereto and positioned on the surface of the main body adjacent to a portion of the surface of the main body that is lightly contacted by the flat edge of the material attached to the second cylinder so as to gently hold the substrate in place as the perforation score or slit is formed therein.

9. The system of claim 1 wherein the main body is constructed of stainless steel.

10. A system for perforating, scoring or slitting a substrate passing between a first cylinder and a second cylinder in a press comprising:

a. a shell wrapped about a first cylinder of the press, said shell including a main body constructed of a hard and flexible sheet-like substance and means for securing the main body to the first cylinder;

b. a material including a flat edge attached to the second cylinder, said flat edge engaging a portion of a surface of the main body of said shell as the substrate passes between the first and second cylinders so that a perforation, score or slit is formed in the substrate; and c. a plurality of friction-enhancing stability strips attached to the surface of the main body adjacent to the portion of the main body surface that is engaged by the flat edge of the material attached to the second cylinder, said stability strips facing radially away from the first cylinder when said shell is attached thereto so as to gently hold the substrate in place as the perforation, score or slit is formed therein.

11. A system for perforating, scoring or slitting a substrate passing between a first cylinder and a second cylinder in a press comprising:

a. a shell wrapped about a first cylinder of the press, said shell including a main body constructed of a hard and flexible sheet-like substance and means for securing the main body to the first cylinder; and b. a material including a flat edge attached to the second cylinder, said flat edge kissing the main body of said shell as the substrate passes between the first and second cylinders so that a perforation, score or slit is formed in the substrate.

* * * * *